US008162713B2

(12) United States Patent
Kasahara et al.

(10) Patent No.: US 8,162,713 B2
(45) Date of Patent: Apr. 24, 2012

(54) LEG MEMBER FOR TRANSFORMABLE TOY

(75) Inventors: Noboru Kasahara, Tokyo (JP); Shinnosuke Okumura, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 443 days.

(21) Appl. No.: 12/529,998

(22) PCT Filed: Mar. 5, 2008

(86) PCT No.: PCT/JP2008/053931

§ 371 (c)(1), (2), (4) Date: Sep. 4, 2009

(87) PCT Pub. No.: WO2008/108397

PCT Pub. Date: Sep. 12, 2008

(65) Prior Publication Data

US 2010/0048093 A1 Feb. 25, 2010

(30) Foreign Application Priority Data

Mar. 7, 2007 (JP) ..... 2007-056982

(51) Int. Cl.
*A63H 3/46* (2006.01)
*A63H 3/36* (2006.01)

(52) U.S. Cl. ..... 446/376; 446/390

(58) Field of Classification Search ..... 446/268, 446/330, 376, 383, 390
See application file for complete search history.

(56) References Cited

U.S. PATENT DOCUMENTS

| | | | | |
|---|---|---|---|---|
| 4,206,564 | A * | 6/1980 | Ogawa | 446/94 |
| 4,274,224 | A * | 6/1981 | Pugh et al. | 446/375 |
| 4,516,948 | A * | 5/1985 | Obara | 446/95 |
| 4,586,911 | A * | 5/1986 | Murakami | 446/376 |
| 4,594,071 | A * | 6/1986 | Zaruba et al. | 446/99 |
| 4,762,513 | A * | 8/1988 | Choy et al. | 446/359 |
| 6,267,640 | B1 | 7/2001 | Akashi et al. | |
| 6,482,068 | B2 * | 11/2002 | Lee et al. | 446/376 |
| 6,692,332 | B2 * | 2/2004 | Jheow | 446/383 |
| 7,331,841 | B2 * | 2/2008 | Okamoto et al. | 446/376 |

FOREIGN PATENT DOCUMENTS

| | | |
|---|---|---|
| JP | 61-45993 | 3/1986 |
| JP | 63-22991 | 2/1988 |
| JP | 3-83599 | 8/1991 |
| JP | 2006-122249 | 5/2006 |

* cited by examiner

*Primary Examiner* — Gene Kim
*Assistant Examiner* — Alyssa Hylinski
(74) *Attorney, Agent, or Firm* — Rankin, Hill & Clark LLP

(57) ABSTRACT

The invention provides a leg member for a transformable toy which prevents impairment of the aesthetic appearance even if the range of motion of a shin section relative to a foot section is increased. A first link member 29 is shaped and configured to cover a circular plate portion 31*b* constituting the main portion of a second link member 31. When the second link member 31 is rotated about the rotation center (axial center of a shaft portion 29*i*) of the second turning pair, portions (31*c* and 31*d*) forming a third turning pair in the second link member 31 are exposed to the outside of the first link member 29. The structure of the shin section and the structures of a third link member 33 and a fourth link member 35 are defined so that the rotation range (a second angular range θ4) of the shin section in a state where the shin section is spaced farthest from the foot section is larger than the rotation range (a first angular range θ3) of the shin section in a state where the shin section is brought closest to the foot section.

18 Claims, 7 Drawing Sheets

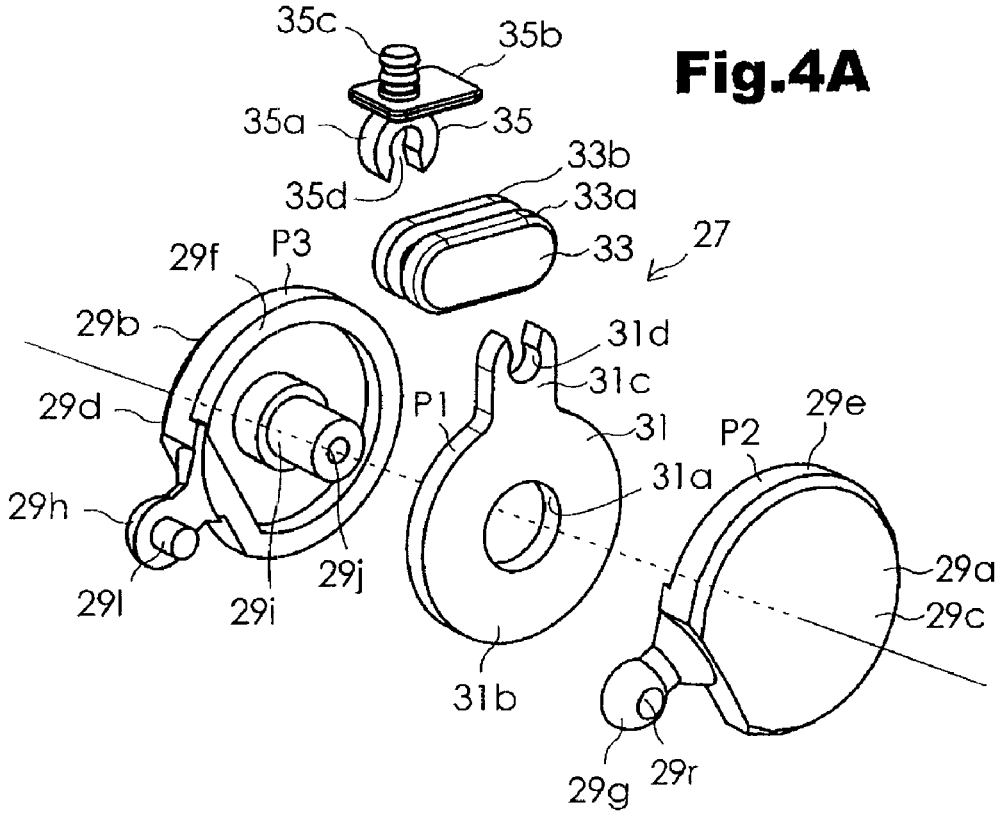
Fig.4A
Fig.4B
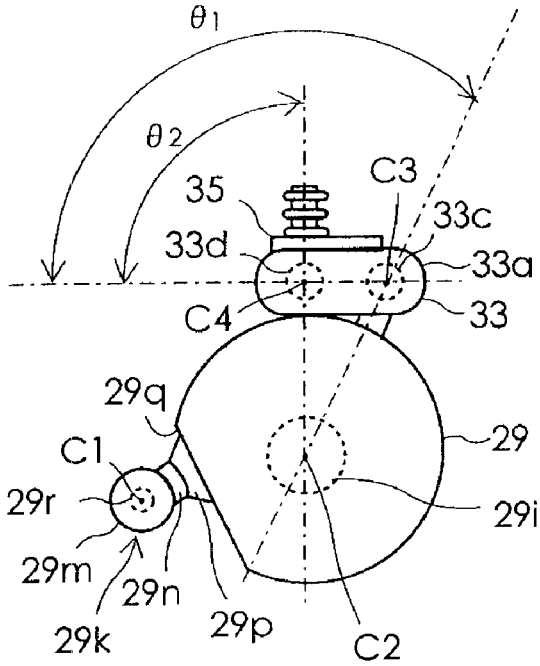

LEG MEMBER FOR TRANSFORMABLE TOY

TECHNICAL FIELD

The present invention relates to a leg member for a transformable toy including a foot section, a shin section, and an ankle section including a joint mechanism that connects the foot section and the shin section.

BACKGROUND ART

Laid-open Japanese utility model publication No. 61-45993 (Patent Document 1) discloses a leg member for a transformable toy including a first member constituting an upper leg section, a second member constituting a lower leg section, and a joint member having a joint mechanism for connecting the first and second members. A circular through-hole in which a spindle of the first member is pivotally supported and an elongate hole in which a spindle of the second member is pivotally supported are formed in the joint member of the known leg member for a transformable toy. The spindle of the second member can be slid in the elongate hole. With this configuration, the second member can be rotated, bent, and expanded/contracted relative to the first member, thereby increasing the range of motion of the second member connected to the first member to some extent.

Patent Document 1: Laid-open Japanese utility model publication No. 61-45993

DISCLOSURE OF THE INVENTION

Problems to be Solved by the Invention

In the case of the conventional leg member for a transformable toy, however, when an attempt is made to increase the range of motion of the second member connected to the first member (in other words, when an attempt is made to change the length of the lower leg section) for transformation, the joint member is largely exposed to the outside beyond necessity, impairing the aesthetic appearance of the transformable toy.

Further, when an attempt is made for a transformable toy using the conventional leg member for a transformable toy to take a pose like a ballerina standing on tiptoe, in which the feet of the transformable toy are stretched with the tiptoes thereof being pointed, the armoring provided on the shin section imposes a large restriction on the motion of the foot section, which makes it impossible for the transformable toy to take such a pose.

An object of the present invention is to provide a leg member for a transformable toy capable of changing the length of the lower leg section and increasing the range of motion of the shin section than ever before.

Another object of the present invention is to provide a leg member for a transformable toy capable of preventing impairment of the aesthetic appearance even if increasing the range of motion of the shin section relative to the feet section.

Means for Solving the Problems

The present invention aims to modify a leg member for a transformable toy including a foot section, a shin section, and an ankle section having a joint mechanism connecting the foot section and shin section. In the present invention, the joint mechanism includes: a first link member connected to the foot section by a first turning pair, a second link member connected to the first link member by a second turning pair, a third link member connected to the second link member by a third turning pair, and a fourth link member connected to the third link member by a fourth turning pair and connected to the shin section. "Connecting by a turning pair" means that two link members are connected such that the two link members rotate about a center line of the turning pair. The first link member is shaped and configured to cover a main portion of the second link member. The second link member includes a portion that forms the third turning pair and is exposed outside the first link member when the second link member is rotated about the rotation center of the second turning pair within a predetermined angular range. The shin section and the third and fourth link members are shaped and configured so as to achieve the following two motions. The first motion is that when the third link member is rotated by a maximum rotatable angle about a rotation center of the third turning pair in one rotation direction and the fourth link member is rotated by a maximum rotatable angle about a rotation center of the fourth turning pair in the other rotation direction opposite to the one rotation direction, the shin section is rotated within a first angular range about the rotation center of the second turning pair in a first state where the shin section receives the third and fourth link members and a part of the first link member therein.

"Maximum rotatable angle" in the present specification is the angle between a position where a rotating link member is in a state where the rotation centers of the second to fourth turning pairs are aligned along a virtual line, and another position where the rotating link member is rotated in one direction or the other direction from the state and abuts on another link member or a stopper portion or the like provided for another link member so that the rotating link member is prevented from being rotated any further in the one direction or the other direction.

The second motion is that the shin section is rotated within a second angular range which is larger than the first angular range about the rotation center of the second turning pair in a second state in which the shin section receives the major part of the third link member and major part of the fourth link member and in which the rotation center of the second turning pair, rotation center of the third turning pair, and rotation center of the fourth turning pair are aligned along a virtual line. With the structures of the shin section and third and fourth link members thus designed, the following deformation can be achieved. That is, both in the first state where the shin section is brought closest to the foot section and the second state where the shin section is spaced farthest from the foot section, the major part of the second link member is covered by the first link member and the third and fourth link members are also received in the shin section. As a result, the length of the lower leg section can be changed without impairing the aesthetic appearance of the lower leg section. Further, in the second state where the shin section is spaced farthest from the foot section, the rotation range (second angular range) of the shin section is larger than the rotation range (first angular range) of the shin section obtained in the first state where the shin section is brought closest to the foot section, so that a possibility that the shin section and foot section interfere with each other is decreased to allow the shape of the lower leg section to be deformed like a ballerina's pose standing on tiptoe, in which the tiptoe is aligned with the shin section.

In order to increase the second angular range, the structure of the foot section should be designed such that when the shin section is rotated in the other rotation direction within the second angular range with the shin section kept in the second state in a state where the bottom surface of the foot section is in full contact with the flat installation plane, the shin section is brought into contact with the installation plane without allowing the shin section to contact the foot section. With this configuration, the shin section does not contact the foot section, thereby reliably achieving a posture like a ballerina standing on tiptoe.

In order to rotate the shin section stably without rattling in a state where the shin section is brought closest to the foot section, the structures of the first to fourth link members should be designed so as to achieve the following two states. A first state is a state where the third link member is rotated about the rotation center of the third turning pair in the one direction and the outer surface of the third link member abuts on the first link member or second link member or a state where the third link member is rotated by the first maximum angle about the rotation center of the third turning pair in the one direction. A second state is a state where the stopper portion provided in the fourth or third link member is brought into contact with the third link member or fourth link member when the fourth link member is rotated in the other direction or a state where the fourth link member is rotated by the second maximum angle about the rotation center of the fourth turning pair in the other direction opposite to the one direction. When the structures of the first to fourth link members are designed so as to achieve the above two states, the rotation ranges of the link members are reliably restricted by the contact between the link members or contact between the link members and stopper portion. Thus, even when the shin section is rotated in a state where the shin section is brought into closest to the foot section, the shape or posture of the lower leg section is kept stable, so that it is possible to rotate the shin section relative to the foot section without rattling.

If the stopper portion is provided in the fourth link member, the stopper portion does not interfere with the motion of the link members other than the third link member, thereby achieving a smooth deformation.

The first angular range which is the rotation range of the shin section obtained while the shin section is brought into closest to the foot section, may be defined as an angular range in which the shin section is rotated about the rotation center of the second turning pair, being maintained in the first state, until a part of the shin section comes into contact with a part of the foot section. With this configuration, the rotation range can be defined without the stopper portion.

Further, a configuration may be adopted in which the second link member, which is rotated about the rotation center of the second turning pair, has an outer peripheral surface that contains an arc surface, and the first link member is configured to allow an outer peripheral surface of the first link member and the arc surface of the second link member to align together to form a surface within a range in which the second link member is rotated. With this configuration, it is possible to make the first and second link members look as if they were one component, preventing impairment of the aesthetic appearance of the ankle section of the leg member for transformable toy.

The first turning pair may be configured to allow the first link member to move by a pivot motion relative to the foot section. The pivot motion is a motion in which a rotational motion and swing motion can be made simultaneously. With this configuration, it is possible to ensure a larger range of motion of the foot section relative to the ankle section, thereby allowing the bottom surface of the foot section and back surface of the shin section to be in full contact with the flat installation plane. In addition, assume that the present invention is applied to a leg member of a humanoid robot toy, the leg sections of the humanoid robot toy are forced to spread open, the center of gravity is shifted on one leg member, and the knee of the one leg member is bent. In this case, even if the other leg member is bent laterally, existence of the first turning pair allows the bottom surface of the other leg section to be in full contact with the flat installation plane.

The first turning pair allowing the pivot motion comprises a projection portion, a part of which is globular, disposed at the first link member, and a recessed portion, a part of which is globular, disposed at the foot section to receive the projecting portion. With this configuration of the first turning pair, it is possible to construct a turning pair allowing the pivot motion with a simple structure.

Each of the second to fourth turning pairs may be constructed by using a joint structure constituted by a shaft which is provided in one of two link members which are connected by each of the turning pairs and a hole or a concave portion which is provided in the other of the two link members so as to be fitted rotatably to a part of the shaft. With this configuration, it is possible to simply construct the joint mechanism of each turning pair and to easily deform a transformable toy such that a larger range of motion of the shin section relative to the foot section is ensured.

The configuration of the present invention described above is summarized as follows.

(1) A leg member for a transformable toy comprising a foot section, a shin section, and an ankle section including a joint mechanism that connects the foot section and the shin section, the joint mechanism including: a first link member connected to the foot section by a first turning pair, a second link member connected to the first link member by a second turning pair, a third link member connected to the second link member by a third turning pair, and a fourth link member connected to the third link member by a fourth turning pair and connected to the shin section; the first link member being shaped and configured to cover a main portion of the second link member; the second link member including a portion that forms the third turning pair and is exposed outside the first link member when the second link member is rotated about the rotation center of the second turning pair within a predetermined angular range; the shin section and the third and fourth link members being shaped and configured to allow the shin section to be rotated about the rotation center of the second turning pair within a first angular range in a first state in which the third and fourth link members and a part of the first link member are received in the shin section when the third link member is rotated by a maximum rotatable angle about the rotation center of the third turning pair in one rotation direction and the fourth Link member is rotated by a maximum rotatable angle about the rotation center of the fourth turning pair in the other rotation direction opposite to the one rotation direction; and the shin section and the third and fourth link members being shaped and configured to allow the shin section to be rotated about the rotation center of the second turning pair within a second angular range, which is larger than the first angular range, in a second state in which a major part of the third link member and a major part of the fourth link member are received in the shin section when the rotation center of the second turning pair, that of the third turning pair, and that of the fourth turning pair align along an imaginary line.

(2) The leg member for a transformable toy according to (1), wherein the foot section is shaped and configured to allow the shin section to come into contact with a flat installation plane without being in contact with the foot section when the shin section is maintained in the second state and is rotated within the second angular range in the other rotation direction with a bottom surface of the foot section being in full contact with the flat installation plane.

(3) The leg member for a transformable toy according to (1), wherein the third link member abuts on the first or second link member at an outer surface of the third link member when the third link member is rotated by the maximum rotatable angle about the rotation center of the third turning pair in the one rotation direction, the third or fourth link member includes a stopper portion, and the first, second, third, and fourth link members are shaped and configured to allow the stopper portion to come into contact with the third or fourth link member when the fourth link member is rotated by the maximum rotatable angle about the rotation center of the fourth turning pair in the other rotation direction opposite to the one rotation direction.

(4) The leg member for a transformable toy according to (3), wherein the stopper portion is disposed at the fourth link member.

(5) The leg member for a transformable toy according to (1), wherein the first angular range is defined as an angular range in which the shin section is rotated about the rotation center of the second turning pair, being maintained in the first state, until a part of the shin section comes into contact with a part of the foot section.

(6) The leg member for a transformable toy according to (1), wherein the second link member, which is rotated about the rotation center of the second turning pair, has an outer peripheral surface that contains an arc surface, and the first link member is configured to allow an outer peripheral surface of the first link member and the arc surface of the second link member to align together to form a surface within a range in which the second link member is rotated.

(7) The leg member for a transformable toy according to (1), wherein the first turning pair is configured to allow the first link member to pivot relative to the foot section.

(8) The leg member for a transformable toy according to (7), wherein the first turning pair comprises a projection portion, a part of which is globular, disposed at the first link member, and a recessed portion, a part of which is globular, disposed at the foot section to receive the globular part of the projecting portion.

(9) The leg member for a transformable toy according to (1), wherein the second turning pair comprises a shaft disposed at one of the first and second link members, and a hole or a recessed portion disposed at the other of the first and second link members, into which a part of the shaft is rotatably fitted.

(10) The leg member for a transformable toy according to (1), wherein the third turning pair comprises a shaft disposed at one of the second and third link members, and a hole or a recessed portion disposed at the other of the second and third link members, into which a part of the shaft is rotatably fitted.

(11) The leg member for a transformable toy according to (1), wherein the fourth turning pair comprises a shaft disposed at one of the third and fourth link members, and a joint structure including a hole or a recessed portion disposed at the other of the third and fourth link members, into which a part of the shaft is rotatably fitted.

BRIEF DESCRIPTION OF THE DRAWINGS

FIG. 4(A) is an enlarged exploded perspective view of the joint mechanism, and FIG. 4(B) is a side view of the joint mechanism obtained by assembling the components shown in FIG. 4(A) with its shaft portion denoted by a dotted line.

BEST MODE FOR CARRYING OUT THE INVENTION

Figure 1:
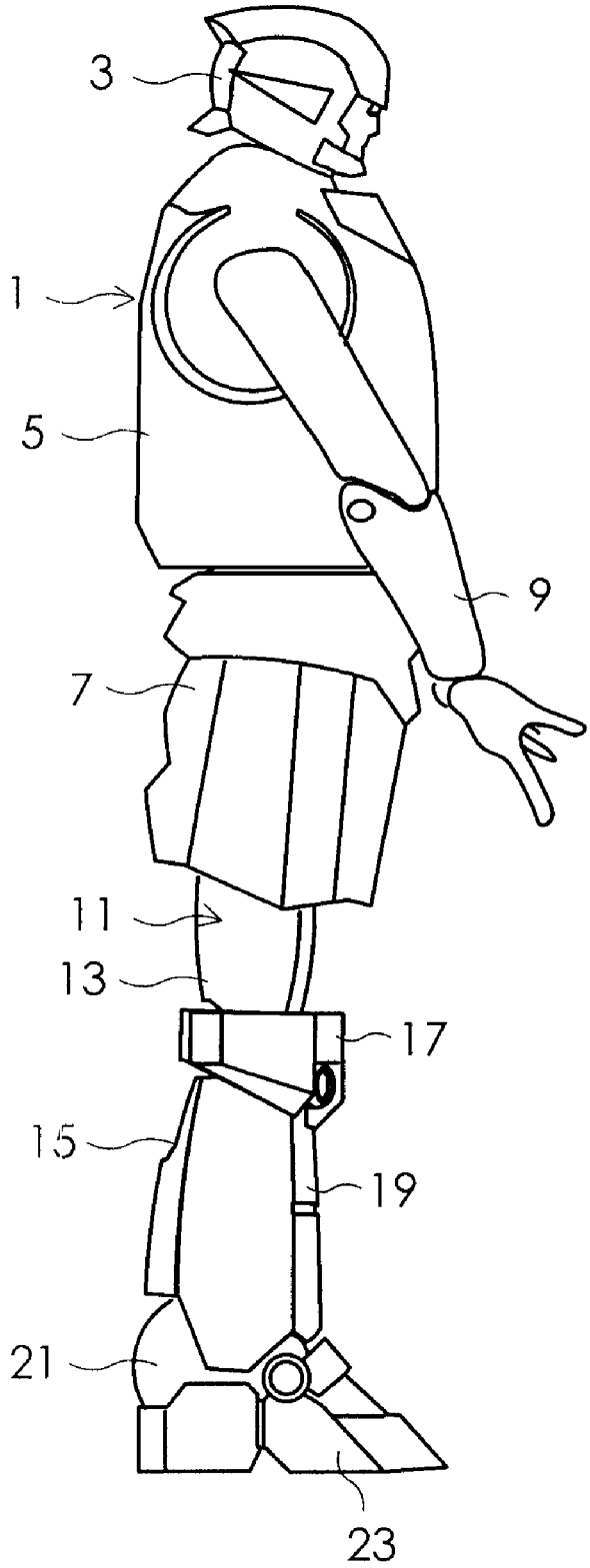
FIG. 1 is a left side view of a humanoid robot toy (transformable toy) adopting a leg member for a transformable toy according to an embodiment of the present invention.

An example of an embodiment of a leg member for a transformable toy according to the present invention will be described in detail below with reference to the accompanying drawings. FIG. 1 is a left side view of a humanoid robot toy (transformable toy) 1 adopting a leg member for a transformable toy according to the present invention in a stand-up state. The humanoid robot toy 1 shown in FIG. 1 includes a head section 3, a trunk section 5, a waist section 7, a pair of arm sections 9, and a pair of leg sections 11. FIG. 1 shows only the right side arm section 9 and right-side leg section 11. In the following description, the right-side leg section 11 will be described as a representative. Known configurations may be adopted as the configurations of the head section 3, trunk section 5, waste section 7, and pair of arm sections 9, and the details thereof are not related to the gist of the present invention, so that the descriptions thereof will be omitted. The leg section 11 is constituted by an upper leg section (thigh section) 13 and a lower leg section 15. The lower leg section 15 is constituted by a knee section 17, a shin section 19, an ankle section 21, and a foot section 23. Although not shown, a joint mechanism for connecting the upper leg section 13 and shin section 19 so as to allow the both sections 13 and 19 to be rotated is provided between them. A part of a joint mechanism provided between the waste section 7 and upper leg section 13 is fitted into a recessed portion 14 formed at the upper end portion of the upper leg section 13.

Figure 2:
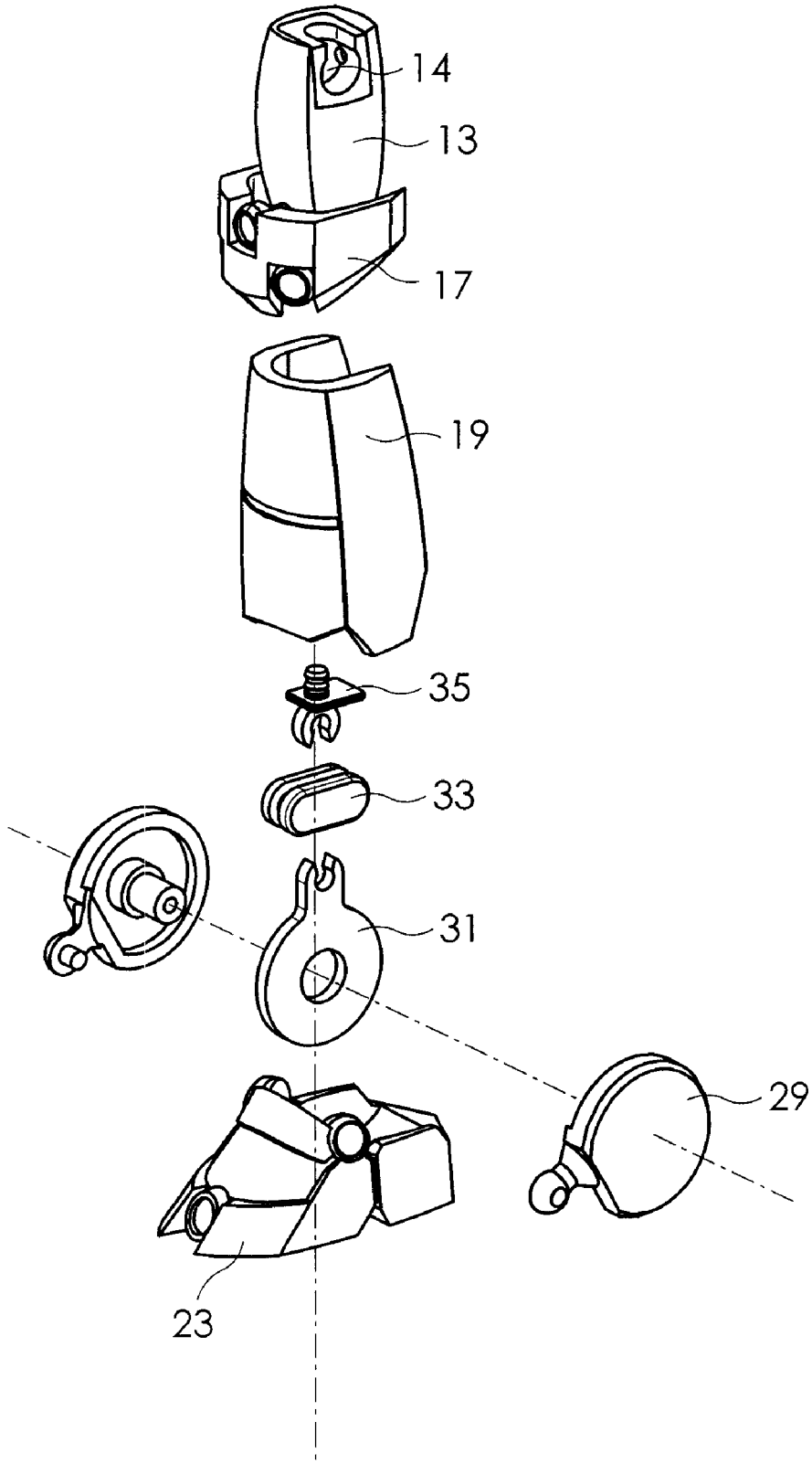
FIG. 2 is a partially exploded perspective view showing a leg section of the humanoid robot toy according to the present embodiment.
Figure 3:
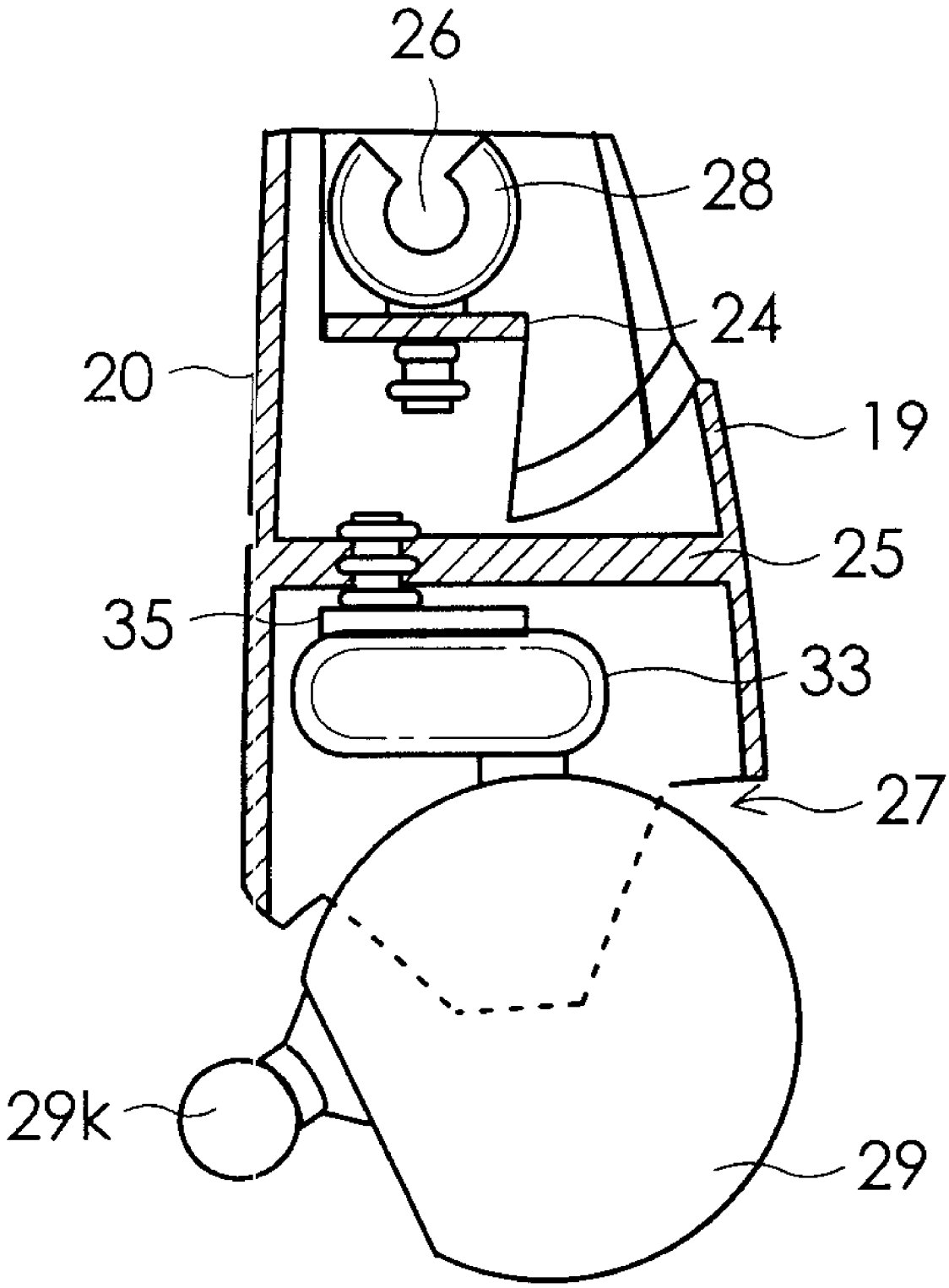
FIG. 3 is a longitudinal cross-sectional view obtained by vertically cutting only an armoring of a shin section in half, which shows the positional relationship between the shin section and a joint mechanism included in an ankle section.

FIG. 2 is a perspective view showing the leg section 11 with the part below the shin section 19 of the lower leg section 15 shown in a partially exploded manner. In the present embodiment, a joint mechanism 27 connecting the foot section 23 and shin section 19 is included in the ankle section 21. FIG. 3 is a longitudinal cross-sectional view obtained by vertically cutting only an armoring 20 of the shin section 19, which shows the positional relationship between the shin section 19 and joint mechanism 27 included in the ankle section 21.

The armoring 20 of the shin section 19 has a hollow structure in which an upper partition wall portion 24 and a lower partition wall portion 25 are integrally formed. A bearing component 28 having a shaft-fitting concave portion 26 used for connecting the knee section 17 and shin section 19 shown in FIG. 1 by means of a turning pair is fitted to the upper partition wall portion 24 by a fitting structure. Further, a fourth link member 35 constituting a part of the joint mechanism 27 is rotatably supported by the lower partition wall portion 25.

The joint mechanism 27 is constituted by a first link member 29 connected to the foot section 23 by a first turning pair, a second link member 31 connected to connected to the first link member 29 by a second turning pair, a third link member 33 connected to the second link member 31 by a third turning pair, and a fourth link member 35 connected to the third link member by a fourth turning pair and connected to the shin section 19. A rotating structure used for constructing the first to fourth turning pairs will be clarified in the following description.

A configuration of the joint mechanism 27 will be described with reference to FIGS. 4(A) and 4(B). FIG. 4(A) is an enlarged exploded perspective view of the joint mechanism 27, and FIG. 4(B) is a side view of the joint mechanism 27 obtained by assembling the components shown in FIG. 4(A) with its shaft portion denoted by a dotted line. The first link member 29 is constituted by a two-piece structure in which first and second casing half portions 29*a* and 29*b* having symmetric shapes are assembled. The first and second casing half portions 29*a* and 29*b* include, respectively, casing half portion main bodies 29*c* and 29*d* each having a shape obtained by linearly cutting a part of circular plate, annular peripheral wall portions 29*e* and 29*f* extending from the inner edge portions of the casing half portion main bodies 29*c* and 29*d* toward their counterparts (casing half portion main bodies 29*d* and 29*c*), and projection half portions 29*g* and 29*h* for globular projection formation each constituting a part of a joint mechanism pivotably connecting the first link member 29 to the foot section. A shaft portion 29*i* constituting a part of a joint mechanism rotatably connecting the first link member 29 and second link member 31 is integrally formed in the center portion of the inner wall surface of the casing half portion main body 29*d* of the second casing half portion 29*b*. Although not shown, a projection to be fitted into a hole 29*j* formed in the leading end of the shaft portion 29*i* are integrally formed in the center portion of the inner wall surface of the casing half portion main body 29*c* of the first casing half portion 29*a*. A fitting though-hole 29*k* is formed in the projection half portion 29*g*, and a fitting cylinder 29*l* is integrally formed in the projection half portion 29*h*. In a state where the first and second casing half portions 29*a* and 29*b* are assembled, the fitting cylinder 29*l* is fitted into the fitting through-hole 29*r*, and the not shown projection is fitted into the hole 29*j* formed in the leading end of the shaft portion 29*i*. The projection half portions 29*g* and 29*h* are connected to form a globular projection portion 29*k*. The globular projection portion 29*k* includes a globular portion 29*m*, a cylindrical portion 29*n*, and a head-cut conical portion 29*p*. The base portion of the head-cut conical portion 29*p* is positioned at a straight surface 29*q* formed when the first and second casing half portions 29*a* and 29*b* are assembled. The edge surface of the peripheral wall portion 29*e* and the edge surface of the peripheral wall portion 29*f* are brought into contact with each other at their portions corresponding to the straight surface 29*q* (base portion of the head-cut conical portion 29*p*) in a state where the first and second casing half portions 29*a* and 29*b* are assembled. However, other edge surface portions of the peripheral wall portions 29*e* and 29*f* are retracted toward the case half portions 29*c* and 29*d* respectively such that they are in a non-contact state. By defining the first link member 29 and foot section 23 as described above, the range of motion of the foot section relative to the ankle section can sufficiently be increased. Thus, even when the transformable toy is deformed such that the center of gravity is shifted on one leg section, the bottom surface of the foot section of the other leg section can be in full contact with the flat installation plane.

The second link member 31 includes a circular plate portion 31*b* having, in the center thereof, a through-hole 31*a* through which the shaft portion 29*i* of the first link member 29 penetrates and a projection piece 31*c* integrally formed in the circular plate portion 31*b* and projecting in the radial direction. Therefore, the outer peripheral surface of the second link member 31 includes a circular arc surface. In the present embodiment, the shaft portion 29*i* of the first link member 29 is made to penetrate through the through-hole 31*a* of the second link member 31, thereby achieving connection between the first and second link members through a turning pair (second turning pair). An opening 31*d* is formed in the projection piece 31*c*.

The opening 31*d* opens outward in the radial direction as viewed from the shaft portion 29*i* and in both directions (both directions in the thickness direction of the projection piece 31*c*) in the axial line direction as viewed from the shaft portion 29*i*. When viewed in the axial line direction, the inner peripheral surface of the opening 31*d* has a shape obtained by partly cutting a circle in the radial direction. The diameter of the circle is slight larger than the diameter of a shaft portion 33*c* formed in the third link member 33. The width dimension (dimension measured in the peripheral direction of the circular plate portion 31*b*) of the opening portion of the opening 31*d* that opens outward in the radial direction is set smaller than the diameter of the shaft portion 33*c* formed in the third link member 33. Thus, the shaft portion 33*c* is fitted in the opening 31*d* in such a manner as to expand the opening 31*d*. Accordingly, after the fitting, the shaft portion 33*c* is not easy to be removed. In the present embodiment, the shaft portion 33*c* of the third link member 33 is fitted in the opening 31*d* of the second link member 31, thereby achieving connection between the second and third link members through a turning pair (third turning pair).

The diameter of the circular plate 31*b* of the second link member is substantially the same as the outer diameters of the peripheral wall portions 29*e* and 29*f* of the first and second casing half portions 29*a* and 29*b* constituting the first link member 29. As a result, in a state where the first and second casing half portions 29*a* and 29*b* are assembled, the circular plate portion 31*b* of the second link member 31 is rotated within a predetermined angular range about the shaft portion 29*i* in a gap between the first and second cashing half portions 29*a* and 29*b*. At this time, a portion P1 corresponding to the circular arc surface of the outer peripheral surface of the circular plate 31*b* of the second link member 31 and outer peripheral surfaces P2 and P3 of the peripheral wall portions 29*e* and 29*f* of the first and second casing half portions 29*a* and 29*b* are aligned. Accordingly, the existence of the second link member 31 cannot be confirmed at a glance.

The third link member 33 has a structure obtained by combining two elongate plates 33*a* and 33*b* each having both ends curved in an arc shape and two shaft portions 33*c* and 33*d* disposed so as to connect the elongate plates 33*a* and 33*b* with a predetermined space therebetween. The two shaft portions 33*c* and 33*d* are denoted by dotted lines in FIG. 4(B). The two shaft portions 33*c* and 33*d* are disposed spaced apart from each other in the longitudinal direction of the elongate plates 33*a* and 33*b*.

The fourth link member 35 is connected to the shaft portion 33*d* of the third link member 33 so as to construct a turning pair. The fourth link member includes a fitting portion 35*a* to be fitted over the shaft portion 33*d* of the third link member, a plate-like stopper portion 35*b*, and a fitting projection portion 35*c* to be fitted to the lower partition wall portion 25 of the shin section 19. As viewed when being fitted over the shaft portion 33*d*, the fitting portion 35*a* has an opening 35*d* that opens in both the radial direction and axial line direction of the shaft portion 33*d*. The shape of the inner peripheral surface of the opening 35*d* exhibits a part of a circle, and the diameter of the circle is slightly larger than the outer diameter of the shaft portion 33*d*. The width dimension (length of the opening portion of the opening 35*d* measured in the peripheral direction of the shaft portion 33*d*) of the opening portion of the opening 35*d* that opens in the radial direction is smaller than the diameter of the shaft portion 33*d*. Thus, the shaft portion 33*d* is fitted in the opening 35*d* in such a manner as to push and expand the opening 35*d*. In the present embodiment, the shaft portion 33*d* of the third link member 33 is fit in the opening 35*d* of the fourth link member 35, thereby achieving connection between the third and fourth link members through a turning pair (fourth turning pair).

The stopper portion 35*b* exercises a stopper function in a state where it is brought into contact with the outer surfaces of the two plates 33*a* and 33*b* of the third link member 33 in a posture shown in FIG. 4(B). That is, in a state shown in FIG. 4(B), the fourth link member 35 can be rotated in a counterclockwise direction but cannot be rotated in a clockwise direction. The shape of the arc shaped curved surfaces at both ends in the longitudinal direction of the two plates 33*a* and 33*b* forming the third link member 33 is defined so as to allow the stopper portion 35*b* to be rotated in the counterclockwise direction in a state shown in FIG. 4(B). The fitting projection portion 35*c* of the fourth link member 35 is rotatably fitted into the lower partition wall portion 25 so that the fourth link member 35 can be rotated by a predetermined angle about the fitting projection portion 35*c* in the fitting state.

Figure 5A:
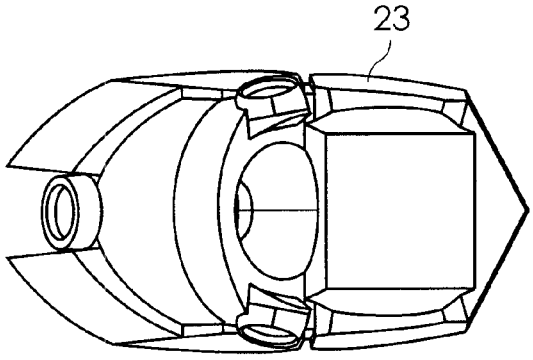
FIGS. 5(A), 5(B), and 5(C) are plan, right side, and back side views of a foot section according to the present embodiment.
Figure 5B:
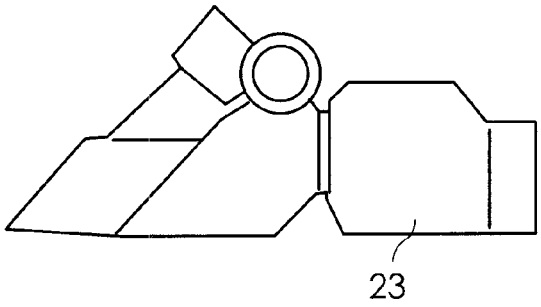
Figure 5C:
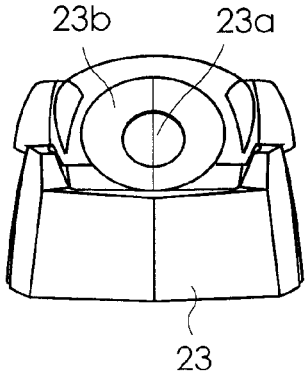

FIGS. 5(A), 5(B), and 5(C) are plan, right side, and back side views of the foot section 23. The foot section 23 has a two-piece structure and has a concave portion 23*a* in which a globular portion 29*m* of the globular projection portion 29*k* of the first link member 29 described above is pivotably (swingably and rotatably) received. An annular tapered surface 23*b* is formed around the opening portion of the concave portion 23*a*. The outer peripheral surface of the head-cut conical portion 29*p* of the globular projection portion 29*k* is brought into contact with the annular tapered surface 23*b* in a state where the globular portion 29*m* of the globular projection portion 29*k* is fitted in the concave portion 23*a*. In the present embodiment, the globular portion 29*m* is swingably and rotatably received in the concave portion 23*a*, thereby achieving connection between the first link member 29 and foot section 23 through a turning pair (first turning pair).

In the present embodiment, the first turning pair is designed so as to allow the first link member 29 to be pivoted relative to the foot section 23 about a rotation center C1 of the first turning pair. Thus, in the present embodiment, it is possible to ensure a larger range of motion of the foot section 23 relative to the ankle section 21, thereby allowing the bottom surface of the foot section 23 and back surface of the shin section 19 to be in full contact with the flat installation plane. Further, assume that the pair of leg members of the humanoid robot toy 1 is forced to spread open, the center of gravity is shifted on one leg member, and the knee of the one leg member is bent. In this case, even if the other leg member is bent laterally, existence of the first turning pair allows the bottom surface of the other foot section to be in full contact with the flat installation plane.

Figure 6A:
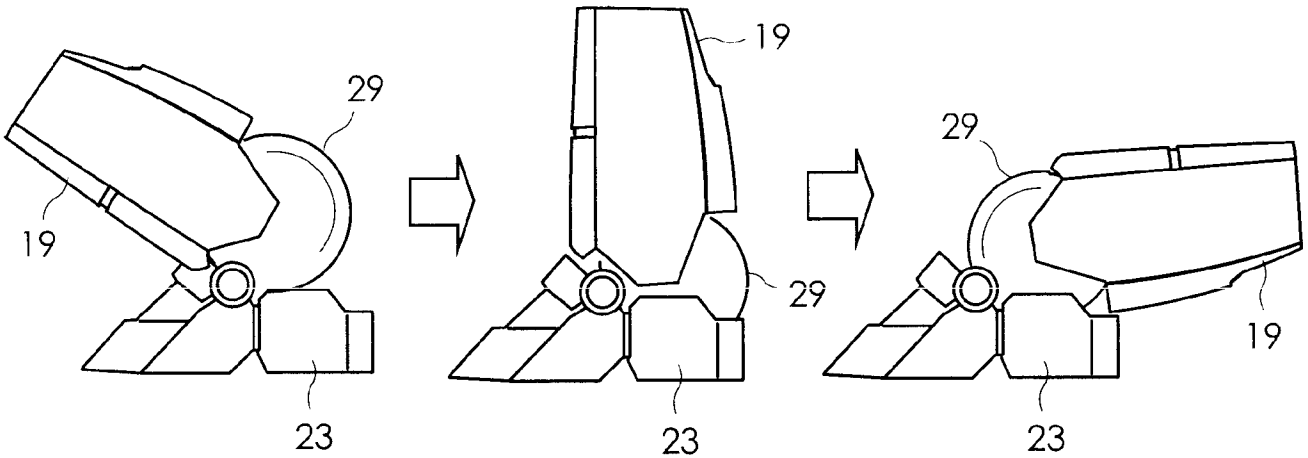
FIGS. 6(A) and 6(B) are views for explaining the motion in which the shin section is rotated about the rotation center of the second turning pair in a first state and the motions of link members at this time.
Figure 6B:
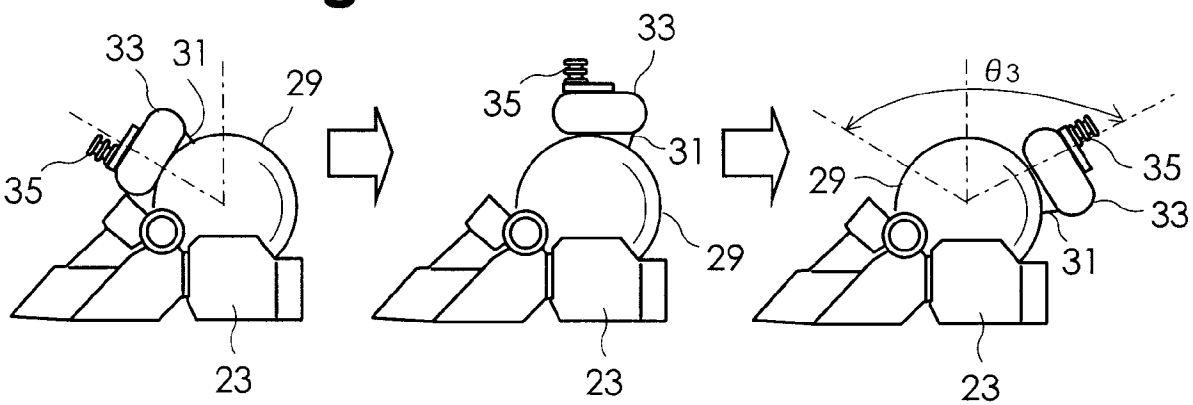

In the above embodiment, the first link member 29 has a structure that can cover the circular plate portion 31*b* constituting the main part of the second link member 31. When the second link member 31 is rotated about a rotation center C2 (axial center of the shaft portion 29*i*) of the second turning pair within a predetermined angular range, the projection piece 31*c* and opening 31*d* of the second link member 31 that constitute the third turning pair are exposed outside the first link member 29. According to the structures of the shin section 19 and third and fourth link members 33 and 35, the following two motions can be achieved. The first motion is that when the third link member 33 is rotated by a maximum rotatable angle θ1 (about 135° in this example) about a rotation center C3 (axial center of the shaft portion 33*c*) of the third turning pair in one rotation direction (counterclockwise direction in FIG. 4(B)) and the fourth link member 35 is rotated by a maximum rotatable angle θ2 (about 90° in this example) about a rotation center C4 (axial center of the shaft portion 33*d*) of the fourth turning pair in the other rotation direction (clockwise direction) opposite to the one rotation direction (counterclockwise direction), the shin section 19 is rotated within a first angular range θ3 about the rotation center C2 (axial center of the shaft portion 29*i*) of the second turning pair in a first state where the shin section 19 receives the third and fourth link members 33 and 35 and a part of the first link member 29 therein. The maximum angle θ1 (about 135° in this example) is the angle at which the outer surface of the third link member 33 is brought into contact with the outer peripheral surface of the peripheral wall portions 29*e* and 29*f* of the first link member 29 to prevent the third link member 33 from being rotated any further. The maximum angle θ2 (about 90° in this example) is the angle at which the stopper portion 35*b* is brought into contact with the two plates 33*a* and 33*b* of the third link member 33 to be prevented from being rotated any further. The first angular range θ3 is the angular range over which the second link member 29 can be rotated, as shown in FIG. 6(A), from the position at which the armoring of the shin section 19 interferes (abuts) with the foot section 23 when the shin section 19 is laid down to the front side of the foot section 23 to the position at which the armoring of the shin section 19 interferes (abuts) with the foot section 23 when the shin section 19 is laid down to the back side of the foot section 23. FIG. 6(B) is a view showing the motions of the first to fourth link members corresponding to the motion shown in FIG. 6(A).

Figure 7A:
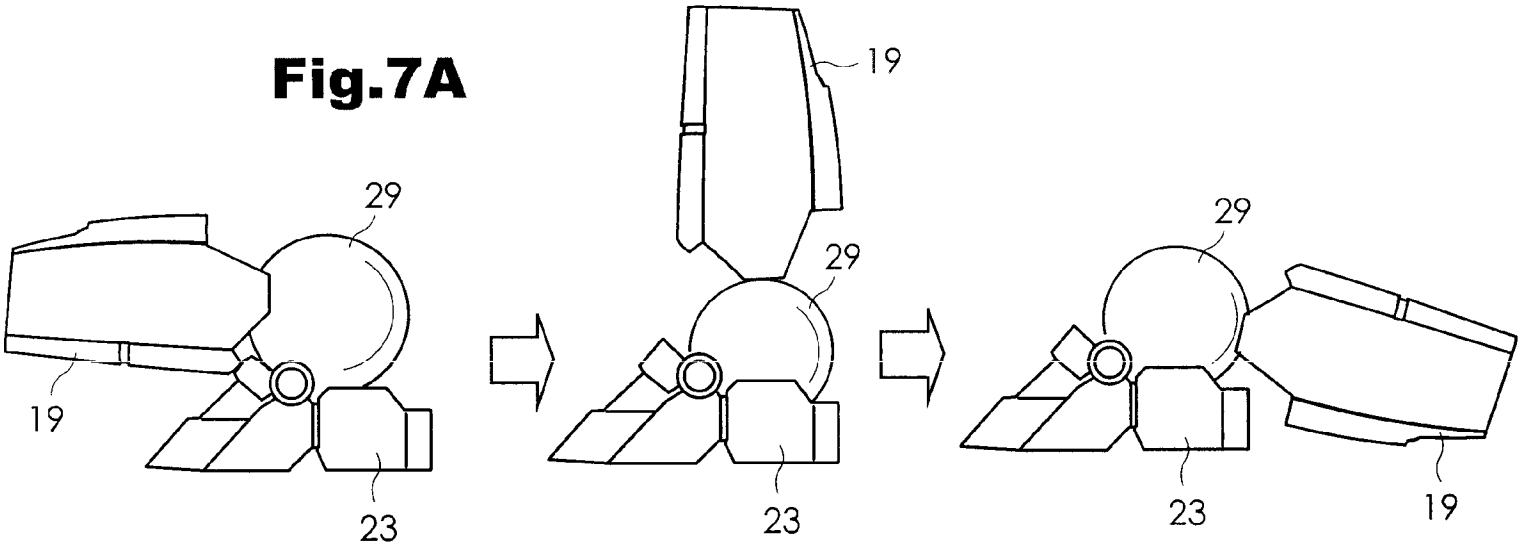
FIGS. 7(A) and 7(B) are views for explaining the motion in which the shin section is rotated about the rotation center of the second turning pair in a second state and the motions of link members at this time.
Figure 7B:
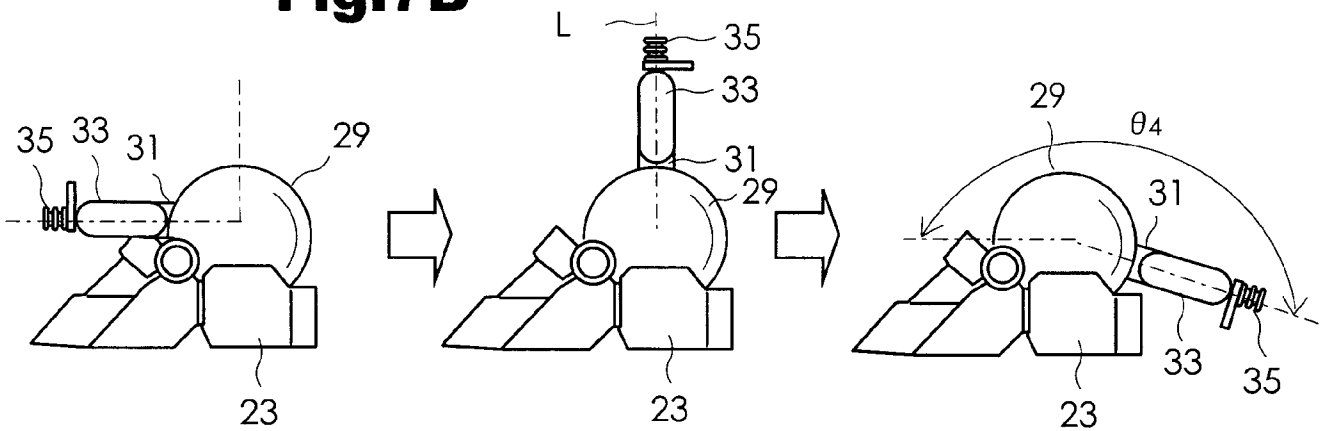

The second motion is that the shin section 19 is rotated within a second angular range θ4 which is larger than the first angular range θ3 about the rotation center C2 (axial center of the shaft portion 29*i*) of the second turning pair in a second state shown in FIG. 7(B) where the shin section 19 receives the major part of the third link member 33 and the major part of the fourth link member 35 when the rotation center C2 (axial center of the shaft portion 29*i*) of the second turning pair, rotation center C3 (axial center of the shaft portion 33*c*) of the third turning pair, and rotation center C4 (axial center of the shaft portion 33*d*) of the fourth turning pair are aligned along a virtual line L. The second angular range θ4 is the angular range over which the second link member 29 can be rotated, as shown in FIG. 7(A), from the position at which the armoring of the shin section 19 interferes (abuts) with the foot section 23 when the shin section 19 is laid down to the front side of the foot section 23 to the position at which the armoring of the shin section 19 interferes (abuts) with the installation plane when the shin section 19 is laid down to the back side of the foot section 23. FIG. 7(B) is a view showing the motions of the first to fourth link members corresponding to the motion shown in FIG. 7(A).

With the structures of the shin section 19 and the third and fourth link members 33 and 35 thus designed, the following deformation can be achieved. That is, both in the first state (state shown in FIG. 6) where the shin section 19 is brought closest to the foot section 23 and second state (state shown in FIG. 7) where the shin section 19 is spaced farthest from the foot section 23, the main part (circular plate portion 31*b*) of the second link member 31 is covered by the first link member 29 and the third and fourth link members 33 and 35 are also received in the shin section 19. As a result, the length of the lower leg section can be changed without impairing the aesthetic appearance of the lower leg section. Further, in the second state (state shown in FIG. 7) where the shin section 19 is spaced farthest from the foot section 23, the rotation range (second angular range θ4) of the shin section 19 is larger than the rotation range (first angular range θ3) of the shin section 19 obtained in the first state (state shown in FIG. 6) where the shin section 19 is brought closest to the foot section 23, so that a possibility that the shin section 19 and foot section 23 interfere with each other is decreased to allow the shape of the lower leg section to be deformed like a ballerina's pose standing on tiptoe in which the tiptoe is align with the shin section 19.

In the present embodiment, in order to increase the second angular range θ4, the structure of the foot section 23 is designed such that when the shin section 19 is rotated in the other rotation direction (clockwise direction on the drawing) within the second angular range, with the shin section 19 in the second state (state shown in FIG. 7), in a state where the bottom surface of the foot section 23 is in full contact with the flat installation plane, the shin section 19 is brought into contact with the installation plane without allowing the shin section 19 to contact the foot section 23.

Further, in the present embodiment, in order to rotate the shin section 19 stably without rattling in a state where the shin section 19 is brought closest to the foot section 23, the structures of the first to fourth link members 29 to 35 are designed so as to achieve the following two states. The first state is a state where the third link member 33 is rotated about the rotation center C3 (axial center of the shaft portion 33*c*) of the third turning pair in the one direction (counterclockwise direction on the drawing) and the outer surface of the third link member 33 abuts on the first link member 29 or second link member 31 or a state where the third link member 33 is rotated by the first maximum angle θ1 about the rotation center C3 (axial center of the shat portion 33*c*) of the third turning pair in the one direction. The second state is a state where the stopper portion 35*b* is brought into contact with the third link member 33 when the fourth link member 35 is rotated in the other direction or a state where the fourth link member 35 is rotated by the second maximum angle θ2 about the rotation center C4 (axial center of the shaft portion 33*d*) of the fourth turning pair in the other direction (clockwise direction on the drawing) opposite to the one direction (counterclockwise direction on the drawing). When the structures of the first to fourth link members 29 to 35 are designed so as to achieve the above two states, the rotation ranges of the link members are reliably restricted by the contact between the link members 31 and 33 or contact between the link members 33 and stopper portion 35*b*. Thus, even when the shin section 19 is rotated in a state where the shin section 19 is brought into closest to the foot section 23, the shape or posture of the lower leg section is kept stable, so that it is possible to rotate the shin section 19 relative to the foot section 23 without rattling.

In the present embodiment, each of the second to fourth turning pairs is constructed by using a joint structure constituted by a shaft (29*i*, 33*c*, or 33*d*) which is provided in one of two link members which are connected by each of the turning pairs and a hole 31*a*, a concave portion (or opening) 31*c*, or 35*d* which is provided on the other of the two link members so as to be fitted to a part of the shaft, respectively, so that it is possible to simply construct the joint mechanism of each turning pair.

INDUSTRIAL APPLICABILITY

According to the present invention, both in the first state where the shin section is brought closest to the foot section and second state where the shin section is spaced farthest from the foot section, the main part of the second link member is covered by the first link member and the third and fourth link members are also received in the shin section. As a result, the length of the lower leg section can be changed without impairing the aesthetic appearance of the lower leg section. Further, in the second state where the shin section is spaced farthest from the foot section, the rotation range (second angular range) of the shin section is larger than the rotation range (first angular range) of the shin section obtained in the first state where the shin section is brought closest to the foot section, so that a possibility that the shin section and foot section interfere with each other is decreased to allow the shape of the lower leg section to be deformed like a ballerina's pose standing on tiptoe, in which the tiptoe is aligned with the shin section.

The invention claimed is:

1. A leg member for a transformable toy comprising a foot section, a shin section, and an ankle section including a joint mechanism that connects the foot section and the shin section, the joint mechanism including:

a first link member connected to the foot section by a first turning pair, a second link member connected to the first link member by a second turning pair, a third link member connected to the second link member by a third turning pair, and a fourth link member connected to the third link member by a fourth turning pair and connected to the shin section;

the first link member being shaped and configured to cover a main portion of the second link member;

the second link member including a portion that forms the third turning pair and is exposed outside the first link member when the second link member is rotated about a rotation center of the second turning pair within a predetermined angular range;

the shin section and the third and fourth link members being shaped and configured to allow the shin section to be rotated about the rotation center of the second turning pair within a first angular range in a first state in which the third and fourth link members and a part of the first link member are received in the shin section when the third link member is rotated by a maximum rotatable angle about a rotation center of the third turning pair in one rotation direction and the fourth link member is rotated by a maximum rotatable angle about a rotation center of the fourth turning pair in the other rotation direction opposite to the one rotation direction;

the shin section and the third and fourth link members being shaped and configured to allow the shin section to be rotated about the rotation center of the second turning pair within a second angular range, which is larger than the first angular range, in a second state in which a major part of the third link member and a major part of the fourth link member are received in the shin section and in which the rotation center of the second turning pair, that of the third turning pair, and that of the fourth turning pair align along an imaginary line;

the foot section being shaped and configured to allow the shin section to come into contact with a flat installation plane without being in contact with the foot section when the shin section is maintained in the second state and is rotated within the second angular range in the other rotation direction with a bottom surface of the foot section being in full contact with the flat installation plane;

the third link member abutting on the first or second link member at an outer surface thereof when the third link member is rotated by the maximum rotatable angle about the rotation center of the third turning pair in the one rotation direction;

the fourth or third link member including a stopper portion, and the first, second, third, and fourth link members being shaped and configured to allow the stopper portion to come into contact with the third or fourth link member when the fourth link member is rotated by the maximum rotatable angle about the rotation center of the fourth turning pair in the other rotation direction opposite to the one rotation direction;

the first angular range being defined as an angular range in which the shin section is rotated about the rotation center of the second turning pair, being maintained in the first state, until a part of the shin section comes into contact with a part of the foot section;

the second link member, which is rotated about the rotation center of the second turning pair, having an outer peripheral surface that contains an arc surface; and the first link member being configured to allow an outer peripheral surface of the first link member and the arc surface of the second link member to align together to form a surface within a range in which the second link member is rotated.

2. The leg member for a transformable toy according to claim 1, wherein the stopper portion is disposed at the fourth link member.

3. The leg member for a transformable toy according to claim 1, wherein the first turning pair is configured to allow the first link member to pivot relative to the foot section.

4. The leg member for a transformable toy according to claim 3, wherein the first turning pair comprises a projecting portion, a part of which is globular, disposed at the first link member, and a recessed portion, a part of which is globular, disposed at the foot section to receive the part of the projecting portion.

5. The leg member for a transformable toy according to claim 1, wherein the second turning pair comprises a shaft disposed at one of the first and second link members, and a hole or a recessed portion disposed at the other of the first and second link members, into which a part of the shaft is rotatably fitted.

6. The leg member for a transformable toy according to claim 1, wherein the third turning pair comprises a shaft disposed at one of the second and third link members, and a hole or a recessed portion disposed at the other of the second and third link members, into which a part of the shaft is rotatably fitted.

7. The leg member for a transformable toy according to claim 1, wherein the fourth turning pair comprises a shaft disposed at one of the third and fourth link members, and a hole or a recessed portion disposed at the other of the third and fourth link members, into which a part of the shaft is rotatably fitted.

8. A leg member for a transformable toy comprising a foot section, a shin section, and an ankle section including a joint mechanism that connects the foot section and the shin section, the joint mechanism including:

a first link member connected to the foot section by a first turning pair, a second link member connected to the first link member by a second turning pair, a third link member connected to the second link member by a third turning pair, and a fourth link member connected to the third link member by a fourth turning pair and connected to the shin section;

the first link member being shaped and configured to cover a main portion of the second link member;

the second link member including a portion that forms the third turning pair and is exposed outside the first link member when the second link member is rotated about a rotation center of the second turning pair within a predetermined angular range;

the shin section and the third and fourth link members being shaped and configured to allow the shin section to be rotated about the rotation center of the second turning pair within a first angular range in a first state in which the third and fourth link members and a part of the first link member are received in the shin section when the third link member is rotated by a maximum rotatable angle about a rotation center of the third turning pair in one rotation direction and the fourth link member is rotated by a maximum rotatable angle about the rotation center of the fourth turning pair in a other rotation direction opposite to the one rotation direction; and the shin section and the third and fourth link members being shaped and configured to allow the shin section to be rotated about the rotation center of the second turning pair within a second angular range, which is larger than the first angular range, in a second state in which a major part of the third link member and a major part of the fourth link member are received in the shin section when the rotation center of the second turning pair, that of the third turning pair, and that of the fourth turning pair align along an imaginary line.

9. The leg member for a transformable toy according to claim 8, wherein the foot section is shaped and configured to allow the shin section to come into contact with a flat installation plane without being in contact with the foot section when the shin section is maintained in the second state and is rotated within the second angular range in the other rotation direction with a bottom surface of the foot section being in full contact with the flat installation plane.

10. The leg member for a transformable toy according to claim 8, wherein the third link member abuts on the first or second link member at an outer surface thereof when the third link member is rotated by the maximum rotatable angle about the rotation center of the third turning pair in the one rotation direction; and the fourth or third link member includes a stopper portion, and the first, second, third, and fourth link members are shaped and configured to allow the stopper portion to come into contact with the third or fourth link member when the fourth link member is rotated by the maximum rotatable angle about the rotation center of the fourth turning pair in the other rotation direction opposite to the one rotation direction.

11. The leg member for a transformable toy according to claim 10, wherein the stopper portion is disposed at the fourth link member.

12. The leg member for a transformable toy according to claim 8, wherein the first angular range is defined as an angular range in which the shin section is rotated about the rotation center of the second turning pair, being maintained in the first state, until a part of the shin section comes into contact with a part of the foot section.

13. The leg member for a transformable toy according to claim 8, wherein the second link member, which is rotated about the rotation center of the second turning pair, has an outer peripheral surface that contains an arc surface; and the first link member is configured to allow an outer peripheral surface of the first link member and the arc surface of the second link member to align together to form a surface within a range in which the second link member is rotated.

14. The leg member for a transformable toy according to claim 8, wherein the first turning pair is configured to allow the first link member to pivot relative to the foot section.

15. The leg member for a transformable toy according to claim 14, wherein the first turning pair comprises a projecting portion, a part of which is globular, disposed at the first link member, and a recessed portion, a part of which is globular, disposed at the foot section to receive the part of the projecting portion.

16. The leg member for a transformable toy according to claim 8, wherein the second turning pair comprises a shaft disposed at one of the first and second link members, and a hole or a recessed portion disposed at the other of the first and second link members, into which a part of the shaft is rotatably fitted.

17. The leg member for a transformable toy according to claim 8, wherein the third turning pair comprises a shaft disposed at one of the second and third link members, and a hole or a recessed portion disposed at the other of the second and third link members, into which a part of the shaft is rotatably fitted.

18. The leg member for a transformable toy according to claim 8, wherein the fourth turning pair comprises a shaft disposed at one of the third and fourth link members, and a hole or a recessed portion disposed at the other of the third and fourth link members, into which a part of the shaft is rotatably fitted.

* * * * *